US011219942B1

(12) United States Patent
Yeo

(10) Patent No.: US 11,219,942 B1
(45) Date of Patent: Jan. 11, 2022

(54) SYSTEM FOR CASTING BY SPLITTING MOLTEN MATERIAL

(71) Applicant: JPS CO., LTD, Gimhae-si (KR)

(72) Inventor: Dong-Hoon Yeo, Gimhae-si (KR)

(73) Assignee: JPS CO., LTD., Gimhae-si (KR)

( * ) Notice: Subject to any disclaimer, the term of this patent is extended or adjusted under 35 U.S.C. 154(b) by 0 days.

(21) Appl. No.: 17/018,834

(22) Filed: Sep. 11, 2020

(30) Foreign Application Priority Data

Jun. 12, 2020 (KR) ..... 10-2020-0071235

(51) Int. Cl.
*B22C 9/08* (2006.01)
*B22C 19/00* (2006.01)

(52) U.S. Cl.
CPC ..... *B22C 9/08* (2013.01); *B22C 19/00* (2013.01)

(58) Field of Classification Search
CPC .. B22C 9/08; B22C 19/00; B22D 3/00; B22D 3/02; B22D 5/00; B22D 5/005; B22D 5/02; B22D 5/04
See application file for complete search history.

(56) References Cited

FOREIGN PATENT DOCUMENTS

| | | | | |
|---|---|---|---|---|
| EP | 3517231 | A1 | 7/2019 | |
| KR | 10-1563363 | B1 | 10/2015 | |
| KR | 10-1587280 | B1 | 1/2016 | |
| KR | 10-1739510 | B1 | 5/2017 | |
| KR | 10-1754067 | B1 | 7/2017 | |
| KR | 101979741 | B1 * | 5/2019 | ..... B22D 45/00 |

* cited by examiner

*Primary Examiner* — Kevin P Kerns
*Assistant Examiner* — Steven S Ha
(74) *Attorney, Agent, or Firm* — Maschoff Brennan

(57) ABSTRACT

A system for casting by splitting molten materials, and more particularly, for casting molten materials received from a furnace into a plurality of unit forms of a predetermined size, including a body unit, forming a main structure of the system, providing a space where the molten materials are received from the furnace; a side packing unit, disposed at the front and rear sides of the body unit, partially covering the body unit.

9 Claims, 4 Drawing Sheets

SYSTEM FOR CASTING BY SPLITTING MOLTEN MATERIAL

CROSS-REFERENCE TO RELATED APPLICATIONS

This application claims under 35 U.S.C. § 119(a) the benefit of priority to Korean Patent Application No. 10-2020-0071235 filed on Jun. 12, 2020, the entire contents of which are incorporated herein by reference.

TECHNICAL FIELD

The present disclosure relates to a system for casting by splitting molten material. More specifically, the present disclosure relates to a casting system for producing a plurality of unit forms of a predetermined size to be used as auxiliary material for steel manufacture by melting and casting ferrosilicon and ferromanganese.

BACKGROUND

Steel manufacture requires not only such raw materials as iron ore, etc. but also such nonferrous metals of different constituents. Nonferrous metals are helpful in modifying the composition of molten metal as they add different elements which remove a predetermined amount of oxygen and sulfur, whereas, in the case of producing such steel products for special use and purpose as stainless steel or electrical sheets, alloying elements, for example ferroalloys, can be added for the purpose of better expressing the characteristic properties of the products.

Ferroalloys refer to various alloys of iron to be used for the purpose of improving the properties of steel products in such ways of removing impurities as deoxidizing or desulfurizing molten metal during smelting. Ferroalloys are auxiliary materials essentially used for producing steel or cast iron.

Using ferroalloys in producing steel products has an advantage of reducing production cost. The purer the metals, the more the production cost incurred as more steps of refining are required. And purer metals have a higher melting point, which, however, can be decreased by adding impurities thereto. In contrast, ferroalloys, due to their low melting point, can be easily melted at a lower temperature and evenly distributed in the melt, which contributes to improving the quality of steel products.

The types and uses of ferroalloys vary depending on which elements are mixed with iron. In most steelmaking, such ferroalloys as ferrosilicon (Fe—Si), ferromanganese (Fe—Mn), ferrosiliconmanganese (Fe—Si—Mn), etc. are commonly used for deoxidizing or desulfurizing. Among those ferroalloys which are additional materials for improving properties of steel products, there are ferrochromium (Fe—Cr), ferrosiliconchromium (Fe—Si—Cr), and ferronickel (Fe—Ni), which are raw materials for stainless steel, and ferromanganese, ferrolead, etc., which are used for imparting special properties to the final products.

In the past, ferroalloys were produced by the same method as the blast furnace process which requires that iron ores be reduced into coke, but ever since the electronic furnace was developed most ferroalloys have been produced with the electronic furnace process.

In 2010, the estimated productions of ferromanganese and ferrosilicon amount to 14.3 m and 7.3 m tones, respectively.

Auxiliary casting materials such as ferroalloys are melted, cooled, crushed, and then used for the casting process; however there is a difficulty that, once crushed by breaking or pulverizing, the auxiliary casting materials vary in size thus hindering their use. Auxiliary casting materials bigger than the standard precipitate causing defects of the products, and on the other hand they are oxidized during the process when their size is smaller than the standard thus having no effect. And auxiliary casting materials have another disadvantage that during the crushing process they produce dust thereby polluting the environment, so various technologies have been developed to overcome this disadvantage.

A prior art patent document on this matter is "Mold, Mold Set and Casting Apparatus" (Korean Registered Patent No. 10-1754067, hereinafter referred to as "Patent Document 1").

The objective of the disclosure of Patent Document 1 is to provide molds, mold sets and a casting apparatus capable of easier discharge of ferrosilicon or ferromanganese without causing condensation. The casting apparatus comprises a distributor distributing molten ferrosilicon or ferromanganese; a mold portion including a plurality of mold sets into which the molten ferrosilicon or ferromanagnese is distributed by the distributor; a transferring portion which drives the mold portion in a loop passing a first curved portion and a second curved portion, wherein the ferrosilicon or ferromanganese in the mold portion cools down and then is discharged at the first curved portion. The mold set comprises a mold holder; a plurality of molds arranged and engaged with the mold holder; fixing portions, disposed at both ends of a connecting bar, fixing the plurality of molds. The mold has a cavity at its center and is made of stone material.

Another prior art patent document is "Stone Mold for Pig Casting Machine" (Korean Registered Patent No. 10-1739510, hereinafter referred to as "Patent Document 2").

The objective of the disclosure of Patent Document 2 is to provide a stone mold for a pig casting machine capable of easier discharge of ferrosilicon or ferromanganese without causing condensation. A stone mold according to the disclosure of Patent Document 2, to be mounted on a pig casting machine casting ferro-type auxiliary casting materials, comprises a belt rotating in a loop by a first stroke and a second stroke, both strokes being spaced apart from each other; a mold holder; a mold portion, disposed in the mold holder, including a plurality of cavities and made of stone material.

Another prior art patent document is "Ferrosilicon Molding Apparatus" (Korean Registered Patent No. 10-1587280, hereinafter referred to as "Patent Document 3").

The objective of the disclosure of Patent Document 3 is to provide a ferrosilicon molding apparatus capable of producing most of the ferrosilicons used in a steelmaking process. For the objective of producing ferrosilicon used as an auxiliary casting material in a steelmaking process, a ferrosilicon molding apparatus comprises a distributor uniformly distributing molten ferrosilicon received from a feeder; an upstream sprocket and a downstream sprocket; a chain device moving in a loop by a driving device; a plurality of mold sets receiving molten ferrosilicon provided by the distributor and seated in a series by the chain device; a cooling device, disposed over the chain device, cooling down the mold sets and the ferrosilicon seated therein; a drier, disposed under the chain device, cooling down the mold sets before entering the distributor, wherein solidified ferrosilicons in the mold sets are discharged at the upstream sprocket.

Another prior art patent document is "Ferrosilicon Molding Method" (Korean Registered Patent No. 10-1563363, hereinafter referred to as "Patent Document 4").

The objective of the disclosure of Patent Document 4 is to provide a method for casting ferrosilicon to be used for most of the steelmaking processes. For this objective, Patent Document 4 discloses a method for casting ferrosilicon to be used as an auxiliary material for a steelmaking process, comprising steps of: distributing, by a distributor, molten ferrosilicon melted by a separate furnace; casting the molten ferrosilicon distributed by the distributor into a predetermined form using mold sets moving in a series; cooling, by a cooling device, the ferrosilicon and the mold sets; discharging the ferrosilicon solidified from the mold sets; cooling, by a cooling device, the mold sets from which the ferrosilocon has been discharged; and drying, by a drier, the mold sets such that moist on the surfaces of the mold sets is removed while the mold sets being cooled down.

It is obvious that the prior art demonstrates advanced aspects in the process of crushing auxiliary casting materials over their predecessors; however, there is still a need for a sophisticated technology for casting auxiliary materials into products of a predetermined size in the molds, easily discharging the cast auxiliary materials from the molds, and preventing a leak of the molten auxiliary materials from between molds.

The above information disclosed in this Background section is only for enhancement of understanding of the background of the disclosure and therefore it may contain information that does not form the prior art that is already known in this country to a person of ordinary skill in the art.

PRIOR ART DOCUMENTS

Patent Documents (Patent Document 0001) Korean Registered Patent No. 10-1754067

(Patent Document 0002) Korean Registered Patent No. 10-1739510

(Patent Document 0003) Korean Registered Patent No. 10-1587280

(Patent Document 0004) Korean Registered Patent No. 10-1563363

SUMMARY

Problems to be Solved

The present disclosure is directed to a system for casting by splitting molten material, which is invented to solve the problems of the prior art as discussed supra, more particularly the problems as below.

First, the present disclosure enables casting molten materials received from a furnace with a desired size and form without a separate step of crushing.

Second, the present disclosure enables distributing and pouring molten materials, evenly, into a plurality of receptacles and a plurality of additional spaces.

Third, the present disclosure enables easily discharging cast molten materials from mold units.

The features of the present disclosure are not limited to the above-mentioned features, and other features not mentioned herein will be clearly understood by those skilled in the art from the following description.

Method for Solving the Problems

A system for casting by splitting molten materials according to the present disclosure has the features as below to solve the above-mentioned problems.

A system for casting by splitting molten materials according to the present disclosure, more particularly, for casting molten materials received from a furnace into a plurality of unit forms of a predetermined size comprises a body unit, forming a main structure of the system, providing a space where the molten materials are received from the furnace; a side packing unit, disposed at the front and rear sides of the body unit, partially covering the body unit.

The body unit of a system according to the present disclosure comprises vessels wherein the vessels provide a plurality of receptacles formed as upward concaves into which the molten materials are poured; subvessels, disposed adjacent to the vessels and formed as upward concave hemispheres, providing a plurality of additional spaces.

Each of the vessels of a system for casting by splitting molten materials according to the present disclosure provides a receptacle defined by a barrier forming an exterior wall and a floor forming a flat bottom.

The floor and the barrier of each of the vessels of a system for casting by splitting molten materials according to the present disclosure meet each other with an angle forming a discontinuous junction such that molten materials cast in the plurality of receptacles can be easily released therefrom.

The subvessels of a system for casting by splitting molten materials according to the present disclosure provides a plurality of additional spaces such that each subvessel surrounds one of the plurality of receptacles.

The subvessels of a system for casting by splitting molten materials according to the present disclosure are each disposed to define each of the plurality of receptacles with a splitting partition further provided such that the molten materials can be divided and received by the plurality of receptacles and additional spaces.

The splitting partition of a system for casting by splitting molten materials according to the present disclosure has, at its center, a peak as an upward protrusion such that the molten materials of a high viscosity are easily divided and received by the plurality of receptacles and additional spaces.

The side packing of a system for casting by splitting molten materials according to the present disclosure comprises a forward packing, disposed at the front of the body unit, the top part thereof upward protruding higher than the top of the body unit; a backward packing, disposed at the rear of the body unit, the top part thereof being upward and backwardly protruding higher than the top of the body unit.

The side packing of a system for casting by splitting molten materials according to the present disclosure, made of a copper alloy, covers the front and rear portions of the body unit such that the body unit is not exposed directly to heat.

The forward packing of a system for casting by splitting molten materials according to the present disclosure has a forward peak, disposed at the top of the forward packing, upward protruding higher than the top of the body unit and partially covering the backward packing.

The backward packing of a system for casting by splitting molten materials according to the present disclosure has a backward peak, disposed at the top of the backward packing, upward protruding higher than the top of the body unit and also backwardly protruding from the body unit.

A system for casting by splitting molten materials according to the present disclosure further comprises, at both sides of the body unit, linking units to connect a plurality of the body units.

Effect of the Present Disclosure

The configurations of a system for casting by splitting molten materials according to the present disclosure described as above can achieve the effects as below.

First, the present disclosure enables casting such conventional auxiliary materials as ferroalloys without crushing, thereby reducing noise and harmful dust, etc. to protect the environment.

Second, the present disclosure enables evenly distributing and pouring the molten auxiliary materials into a plurality of receptacles and additional spaces.

Third, the present disclosure enables easily releasing cast molten materials as a plurality of unit forms from mold units.

The effects of the present disclosure are not limited to the above-mentioned effects, and other effects not mentioned herein will be clearly understood by those skilled in the art from the following description.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein.

Figure 1:
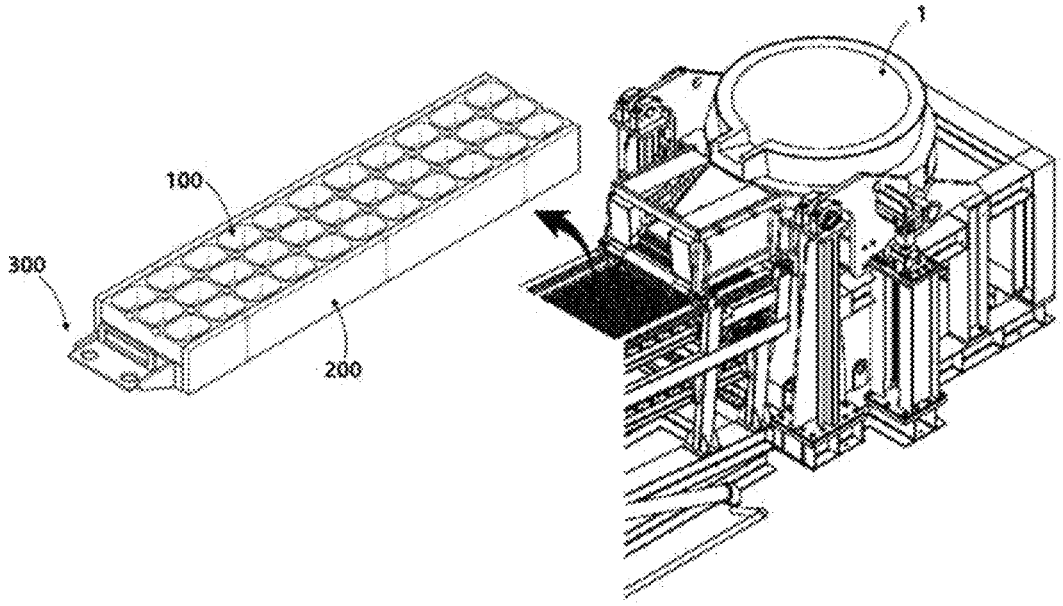
FIG. 1 is a perspective view of an embodiment of a system for casting by splitting molten materials according to the present disclosure.

It should be understood that the appended drawings are not necessarily to scale, presenting a somewhat simplified representation of various preferred features illustrative of the basic principles of embodiments of the disclosure. The specific design features of embodiments of the present disclosure as disclosed herein, including, for example, specific dimensions, orientations, locations, and shapes will be determined in part by the particular intended application and use environment.

In the figures, reference numbers refer to the same or equivalent parts of embodiments of the present disclosure throughout the several figures of the drawing.

DETAILED DESCRIPTION OF ILLUSTRATIVE EMBODIMENT

Hereinafter reference will now be made in detail to various embodiments of the present disclosure, examples of which are illustrated in the accompanying drawings and described below. While the disclosure will be described in conjunction with exemplary embodiments, it will be understood that present description is not intended to limit the disclosure to those exemplary embodiments. On the contrary, the disclosure is intended to cover not only the exemplary embodiments, but also various alternatives, modifications, equivalents and other embodiments, which may be included within the spirit and scope of the disclosure as defined by the appended claims.

Figure 2:
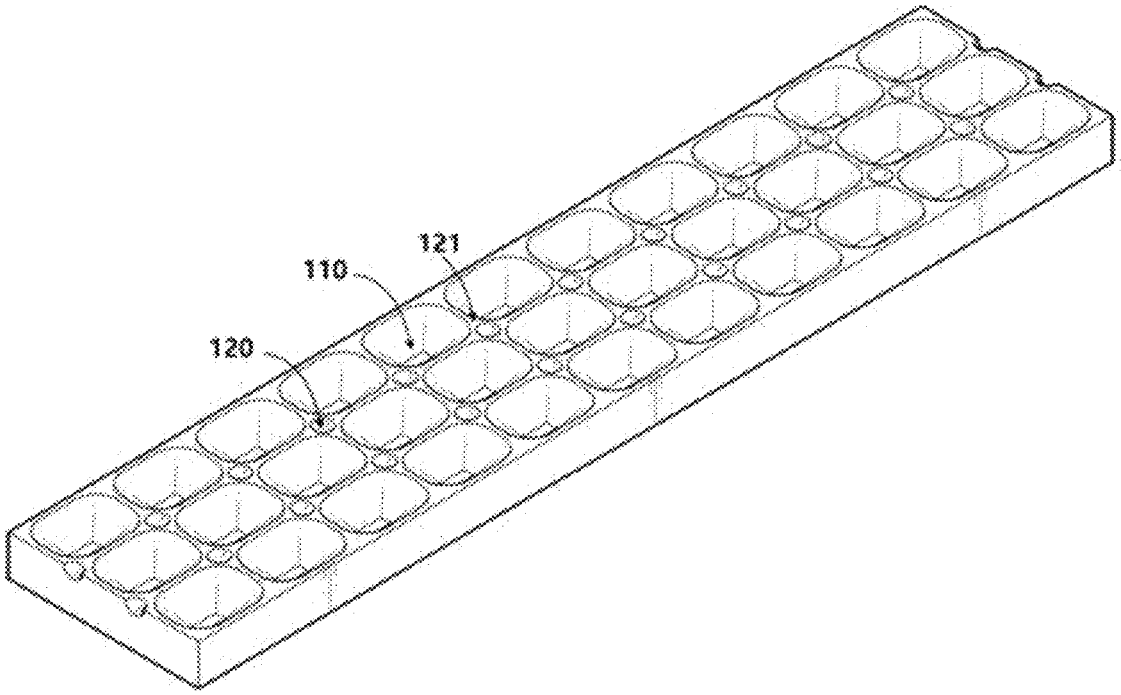
FIG. 2 is a perspective view of a body unit of an embodiment of a system for casting by splitting molten materials according to the present disclosure.
Figure 3:
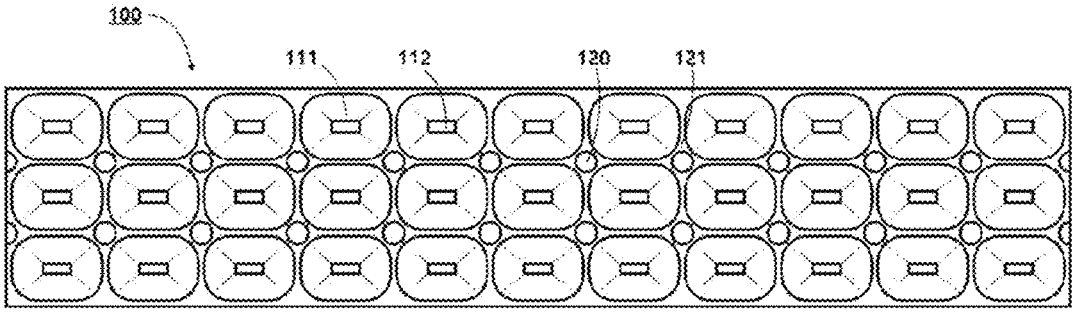
FIG. 3 is a plan view of the body unit of an embodiment of a system for casting by splitting molten materials according to the present disclosure.
Figure 4:
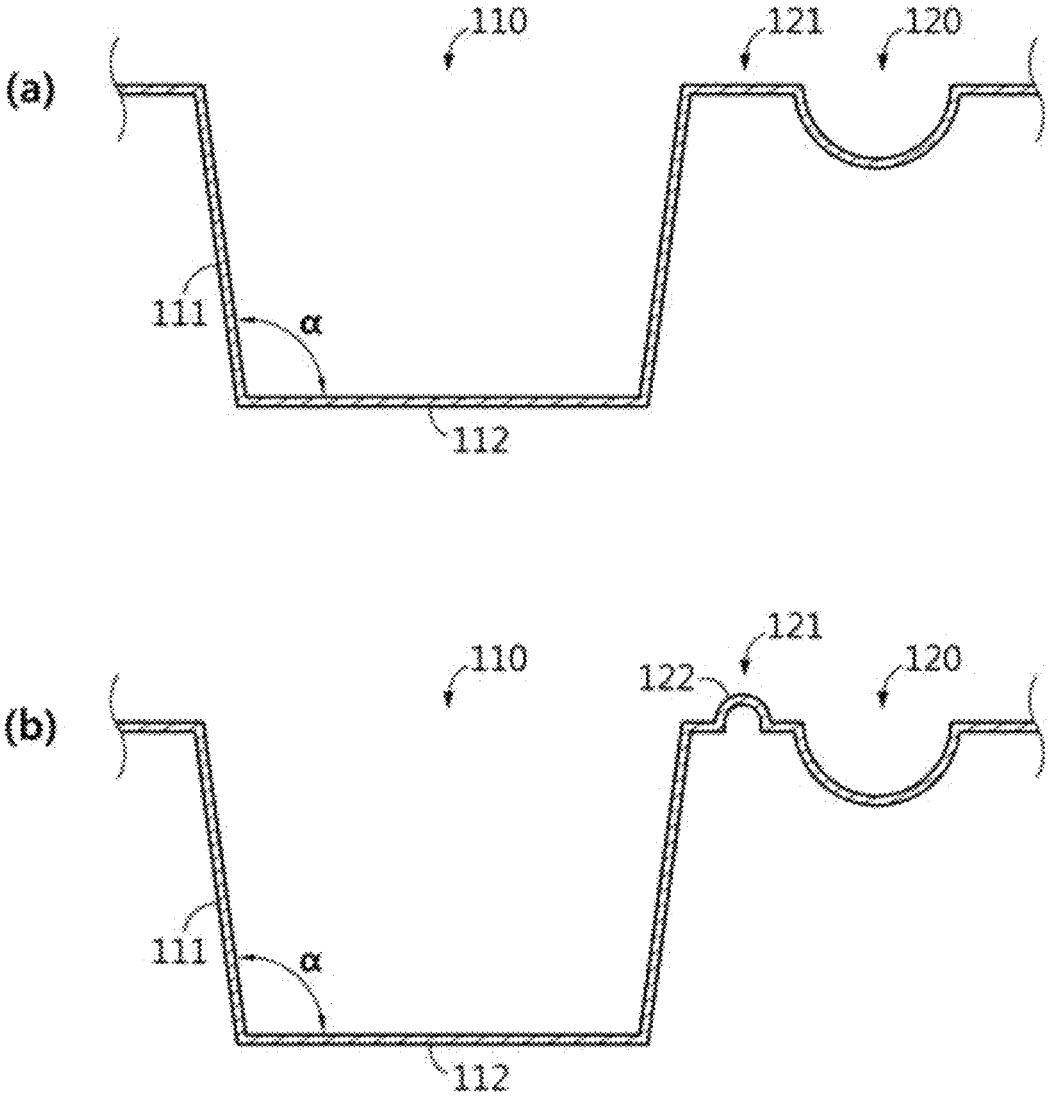
FIG. 4 is a cross-sectional view of the body unit of an embodiment of a system for casting by splitting molten materials according to the present disclosure.
Figure 5:
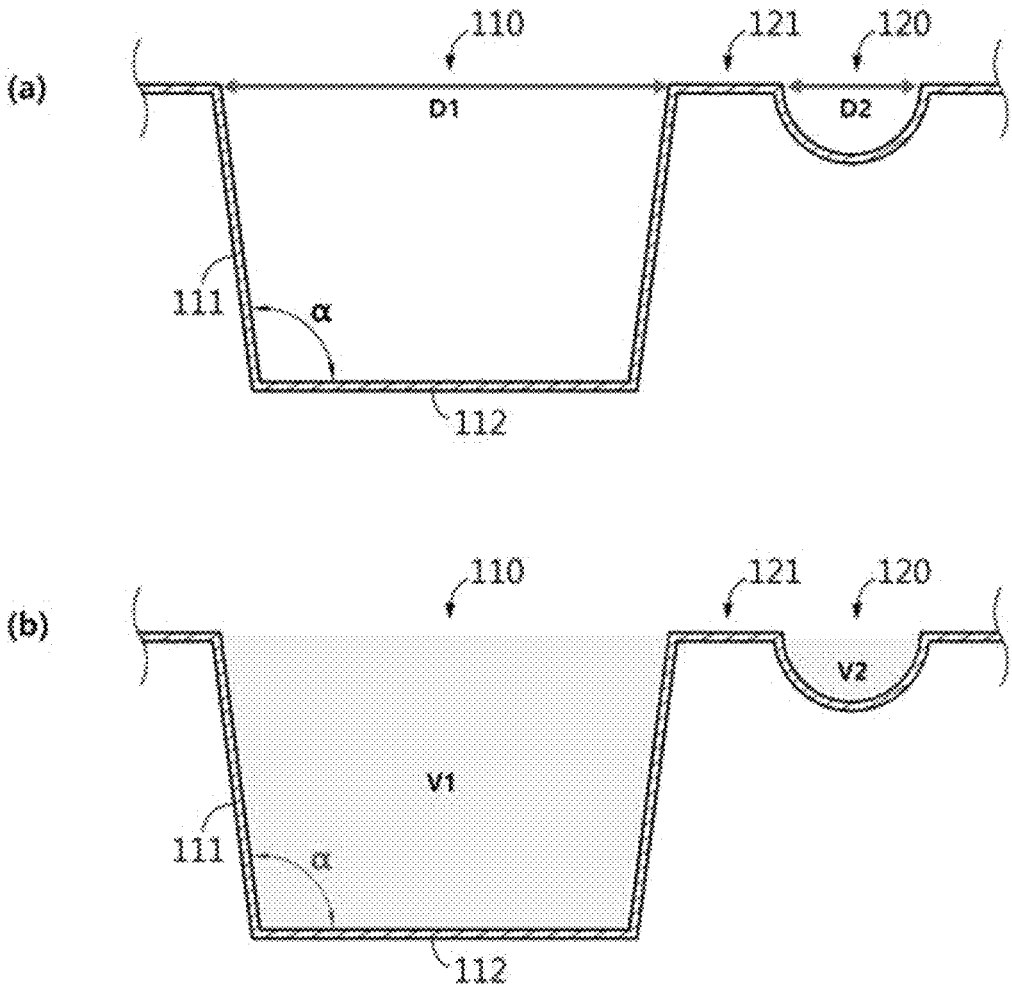
FIG. 5 is a cross-sectional view of the body unit, illustrating its diameter and volume, of an embodiment of a system for casting by splitting molten materials according to the present disclosure.
Figure 6:
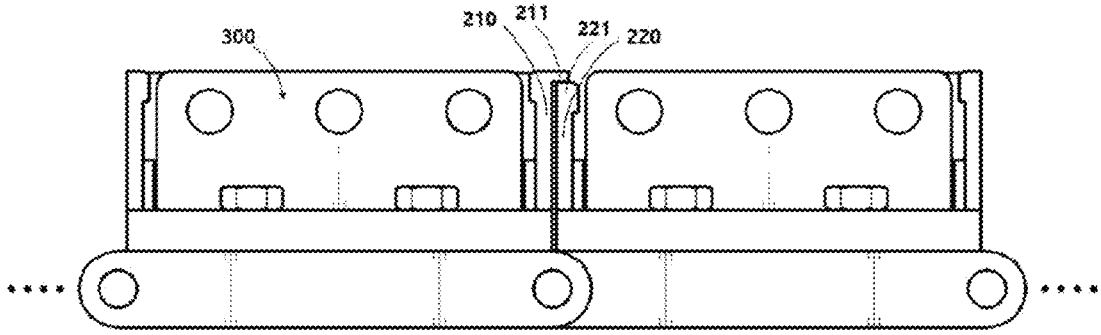
FIG. 6 is a front view of an embodiment of a system for casting by splitting molten materials according to the present disclosure.
Figure 7:
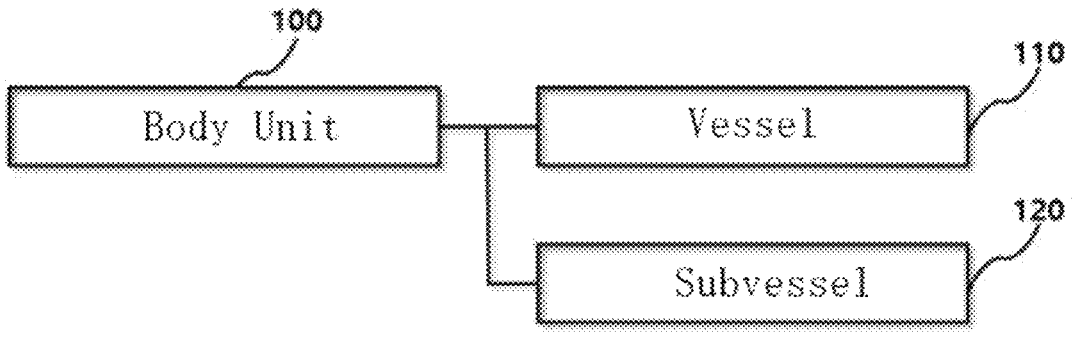
FIG. 7 is a block diagram of an embodiment of a system for casting by splitting molten materials according to the present disclosure.
Figure 8:
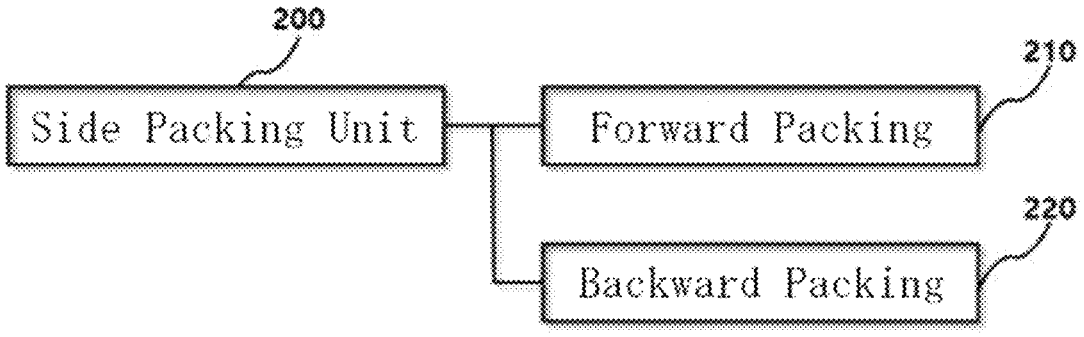
FIG. 8 is a block diagram of the side packing of an embodiment of a system for casting by splitting molten materials according to the present disclosure.

FIG. 1 is a perspective view of one embodiment of a system for casting by splitting molten materials according to the present disclosure. FIG. 2 is a perspective view of a body unit of an embodiment of a system for casting by splitting molten materials according to the present disclosure. FIG. 3 is a plan view of a body unit of an embodiment of a system for casting by splitting molten materials according to the present disclosure. FIG. 4 is a cross-sectional view of a body unit of an embodiment of a system for casting by splitting molten materials according to the present disclosure. FIG. 5 is a cross-sectional view of a body unit, illustrating its diameter and volume, of an embodiment of a system for casting by splitting molten materials according to the present disclosure. FIG. 6 is a front view of an embodiment of a system for casting by splitting molten materials according to the present disclosure. FIG. 7 is a block diagram of an embodiment of a system for casting by splitting molten materials according to the present disclosure. FIG. 8 is a block diagram of a side packing of an embodiment of a system for casting by splitting molten materials according to the present disclosure.

The present disclosure relates to a system for casting by splitting molten materials as shown in FIG. 1, more particularly, a system for producing ferrosilicon (Fe—Si), ferromanganese (Fe—Mn), ferrosiliconmanganese (Fe—Si—Mn) by melting and casting them with a predetermined size to be used as auxiliary materials for a steelmaking process.

Ferrosilicon or ferromanganese discussed herein is an auxiliary ferroalloy which is used for making steel or cast iron; specifically, ferrosilicon is used as a deoxidizer and a reducing agent and as a graphitizing agent for making carbon steel.

A system for casting by splitting molten materials according to the present disclosure is for producing a plurality of unit form products with a predetermined size by using molten materials (molten auxiliary materials for steelmaking) received from a furnace 1.

In general, producing auxiliary casting materials for steelmaking requires a step of crushing, whereas a system according to the present disclosure enables casting auxiliary materials without crushing, thereby preventing noise and dust, as well as a precise process for easily making the auxiliary materials with a desired size.

A system for casting by splitting molten materials according to the present disclosure, as shown in FIGS. 1 and 2, comprises a body unit 100, a side packing unit 200, and a link unit 300.

First, the body unit 100, as shown in FIGS. 1 and 2, forms a body for casting which receives a molten material from the furnace 1.

The body unit 100 is a configuration wherein the molten material is received, cooled down, and then the cast molten material is released from the body unit to be used as an auxiliary material for steelmaking.

The side packing unit 200, as shown in FIGS. 6 and 8, is disposed at a front and a rear of the body unit 100 partially covering the body unit 100.

Herein, the front indicates a direction the body unit 100 moves forward and the rear indicates the opposite direction thereof.

The side packing unit 200 not only covers the front and rear sides of the body unit 100 but also, when the body units are connected to each other, makes them into an infinite loop thereby helping the body unit 100 easily moves.

And the side packing unit 100, formed of a copper alloy, covers the front and rear of the body unit 100, thereby preventing the body unit 100 from being exposed directly to heat.

The side packing unit 100, as it is made of a copper alloy, can prevent the body unit 100 from being damaged by the molten material of a high temperature provided by the furnace 1.

The link units 300, as shown in FIGS. 1 and 6, are provided at both sides of the body unit 100 so as to connect a plurality of the body units 100.

The link units 300 connect a plurality of the body units 100 and move them in an infinite loop so as to cast molten materials with a predetermined size, thus producing a plurality of unit form products.

The body unit 100 of a system for casting by splitting molten materials according to the present disclosure, as shown in FIG. 7, comprises vessels 110 and subvessels 120.

First, the vessels 110, as shown in FIGS. 2 and 3, provide a plurality of upward concave receptacles, into which the molten materials are poured.

The vessels 100 are a plurality of receptacles into which the molten auxiliary casting materials received from the furnace 1 are filled. The cast molten materials become individual unit form products.

The vessels 110 of a system for casting by splitting molten materials according to the present disclosure, as shown in FIG. 4, each comprise a barrier 111 and a floor 112.

The barrier 111 forms an exterior wall of each of a plurality of the receptacles.

The barrier 111 surrounds and defines a plurality of the receptacles.

The floor 112 forms a flat bottom surface of each of a plurality of the receptacles.

As shown in (a) of FIG. 4, the floor 112 and the barrier 111 meet each other with an angle forming a discontinuous junction such that the molten materials cast in a plurality of the receptacles can be easily released therefrom.

Herein, the angle forming a discontinuous junction is, preferably, bigger than the right angle) (90° but smaller than the straight angle (180°).

The barrier may be curved or flat without being limited to a specific form but, preferably, with an obtuse angle forming a discontinuous junction.

The floor 112 has a flat surface and an angle forming a discontinuous junction, such that the cast molten materials can be produced as a polygonal shape.

The subvessels 120, disposed adjacent to a plurality of the receptacles, provide additional spaces with a shape of upward concave hemisphere.

The subvessels 120 provide a plurality of additional spaces smaller than a plurality of the receptacles of the vessels 110. And a plurality of the additional spaces are formed each to surround each of a plurality of the receptacles.

With the subvessels 120, a single body unit 100 can produce as large an amount of the auxiliary materials as possible.

As shown in FIG. 4, a subvessel 120 comprises a splitting partition 121.

The splitting partition 121 is configured to divide the vessels 110 into a plurality of receptacles such that molten materials are divided and received by a plurality of the receptacles and subvessels 120.

The splitting partition 121 is a flat surface between a plurality of the receptacles and a plurality of the additional spaces.

The splitting partition 121, as shown in (b) of FIG. 4, may have a peak 122, which is an upward protrusion disposed at its center, such that molten materials poured into a plurality of the receptacles and a plurality of the additional spaces can be easily divided and received thereinto.

For example, a molten material of a normal or low viscosity can be easily divided and received by a plurality of the receptacles and the additional spaces, whereas a molten material of a high viscosity will not easily be divided; thus a peak is provided to facilitate the division and separate accommodation of the molten materials.

In addition, the auxiliary material produced by a system for casting by splitting molten materials according to the present disclosure is configured to have a size between a minimum of 10 mm and a maximum of 50 mm.

The reason why such a limitation is imposed to the size of the auxiliary materials is because a material bigger than 50 mm tends to precipitate in the steelmaking process thereby causing defects of the products whereas a material smaller than 10 mm tends to be oxidized before achieving its intended effect.

Therefore, the auxiliary materials should be produced with a size of 10 mm 50 mm by the body unit 100.

For such a purpose, as shown in (a) of FIG. 5, the diameter (D1) of each of a plurality of the receptacles and the diameter (D2) of each of a plurality of the additional spaces are configured, preferably, to be 10 mm<D2<D1<50 mm.

Likewise, as shown in (b) of FIG. 5, the volume (V1) of each of a plurality of the receptacles and the volume (V2) of a plurality of the additional spaces are configured, preferably, to be Vmin<V1<V2<Vmax.

Herein, Vmin represents the minimum volume of the auxiliary material, and Vmax the maximum volume thereof used for a steelmaking process.

The side packing unit 200 of a system for casting by splitting molten materials according to the present disclosure, as shown in FIGS. 6 and 8, comprises a forward packing 210 and a backward packing 220.

First, the forward packing 210 is disposed at the front of the body unit 100 with its top portion protruding upward higher than the top of the body unit 100.

The forward packing 210, as shown in FIG. 6, has a forward peak 211.

The forward peak 211, disposed at the top of the forward packing 210, protrudes upward higher than the top of the body unit 100 thus partially covering the backward packing 220.

The backward packing 220, disposed at the rear of the body unit 100, protrudes upward higher than the top of the body unit 100 as well as protrudes backward.

The backward packing 220, as shown in FIG. 6, comprises a backward peak 221.

The backward peak 221, disposed at the top of the backward packing 220, protrudes upward higher than the top of the body unit 100 and also protrudes backward from body unit 100.

When a body unit 100 is connected to another body unit 100, a backward packing 220 of one body unit comes into contact with a forward packing of the other body unit 100.

That is, with body units connected in a series, a forward packing 210 comes into contact with a backward packing 220, in which a forward peak 211 protruding upward partially covers a backward peak 211 protruding upward and backward because of a height step there between.

The scope of the present disclosure is determined by the appended claims, and the parentheses used in claims are intended not to indicate an optional limitation but to more clarify the configuration thereof; therefore any limitations in parentheses should be understood as essential to the disclosure.

What is claimed is:

1. A system for casting by splitting molten materials, wherein the system casts the molten materials provided by a furnace into a plurality of unit form products of a predetermined size, comprising:

a body unit forming a body structure of the system and providing a space where the molten materials provided by the furnace are received;

side packing units, disposed at a front and a rear of the body unit, partially covering the body unit, wherein the body unit provides a plurality of receptacles of an upward concave form, further comprising:

vessels, forming the plurality of receptacles, wherein the molten materials are poured; and subvessels, forming a plurality of additional spaces of upward concave hemisphere, disposed adjacent to each of the plurality of receptacles.

2. The system for casting by splitting molten materials of claim 1, wherein the vessels comprise:

a barrier forming an exterior wall of each of the plurality of receptacles;

a floor forming a flat bottom of each of the plurality of receptacles.

3. The system for casting by splitting molten materials of claim 2, wherein the floor and the barrier meet each other at an angle forming a discontinuous junction such that the molten materials cast in the plurality of receptacles can be released therefrom.

4. The system for casting by splitting molten materials of claim 1, wherein the subvessels, forming the plurality of additional spaces, are configured to surround each of the plurality of receptacles.

5. The system for casting by splitting molten materials of claim 4, wherein the subvessels, forming the plurality of additional spaces, comprise a splitting partition by which the molten materials are divided and accommodated into the plurality of receptacles and the plurality of additional spaces.

6. The system for casting by splitting molten materials of claim 5, wherein the splitting partition comprises a peak, as an upward protrusion disposed at a center thereof, by which the molten materials having a viscosity can be divided and accommodated into the plurality of receptacles and the plurality of additional spaces.

7. The system for casting by splitting molten materials of claim 1, wherein the side packing unit comprises:

a forward packing, disposed at the front of the body unit, protruding upward higher than a top of the body unit;

a backward packing, disposed at the rear of the body unit, protruding upward higher than the top of the body unit and also protruding backward.

8. The system for casting by splitting molten materials of claim 7, wherein the side packing unit, made of a copper alloy, covers the front and the rear of the body unit such that the body unit is not exposed directly to heat.

9. The system for casting by splitting molten materials of claim 1, further comprising link units, provided at both sides of the body unit, connecting a plurality of the body units.

* * * * *